United States Patent [19]

Schroeder

[11] 4,159,603

[45] Jul. 3, 1979

[54] CIRCULAR BUILDING

[75] Inventor: Leonard F. Schroeder, Houston, Tex.

[73] Assignee: Concept Fiberglass Homes, Inc., Grand Island, Nebr.

[21] Appl. No.: 907,980

[22] Filed: May 22, 1978

[51] Int. Cl.[2] ..... E04B 7/00

[52] U.S. Cl. ..... 52/82

[58] Field of Search ..... 52/247, 236.2, 94, 82

[56] References Cited

U.S. PATENT DOCUMENTS

| | | | |
|---|---|---|---|
| 926,707 | 6/1909 | Marshall | 52/247 |
| 1,019,334 | 3/1912 | McClure | 52/82 |
| 1,100,081 | 6/1914 | Kramer | 52/247 |
| 2,256,050 | 9/1941 | Hansen | 52/82 |
| 2,343,764 | 3/1944 | Fuller | 52/222 |
| 2,427,021 | 9/1947 | Rapp | 52/222 |
| 2,896,559 | 7/1959 | Stephens | 52/94 |
| 3,040,478 | 6/1962 | Furguson | 52/82 |
| 3,295,265 | 1/1967 | Hida | 52/82 |
| 3,999,337 | 12/1976 | Tomassetti | 52/82 |

FOREIGN PATENT DOCUMENTS

| | | | |
|---|---|---|---|
| 577240 | 6/1959 | Canada | 52/82 |

*Primary Examiner*—John E. Murtagh

*Attorney, Agent, or Firm*—Ranseler O. Wyatt

[57] ABSTRACT

A circular building having an external wall of curved panels of rigid material such as fiberglass reinforced polyester, and roof panels substantially triangular in shape of the same material secured at one end to the top of said wall panels, and a column supported center ring to which the other ends of said roof panels are secured. A cupola is mounted on the center ring and roof panels, covering the said center ring, and tension bars are provided to reinforce the roof panels against deflection. The foundation is poured after the walls are erected and the center column in place, so that a seal is perfected.

1 Claim, 7 Drawing Figures

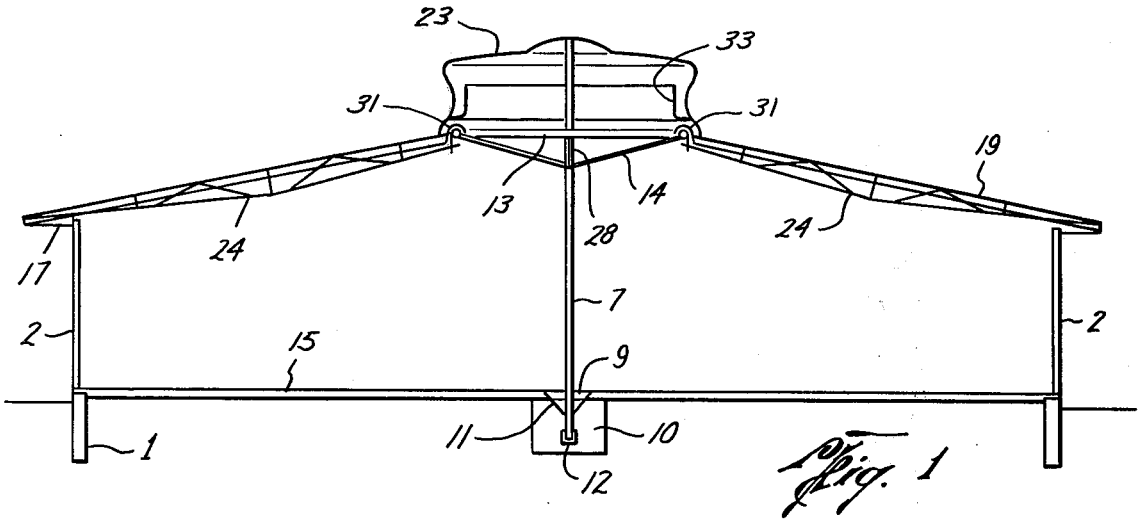
Fig. 1
Fig. 2
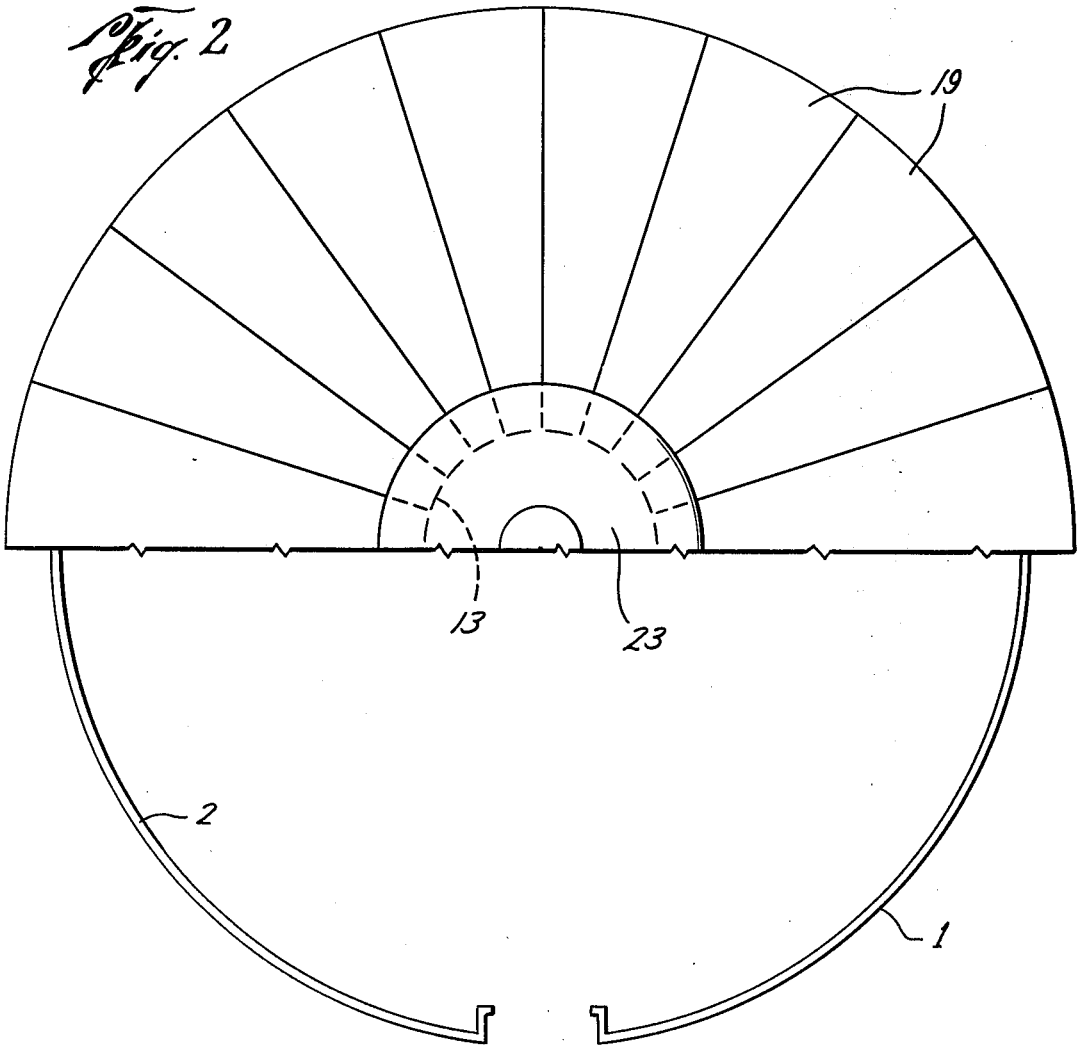

Fig. 3
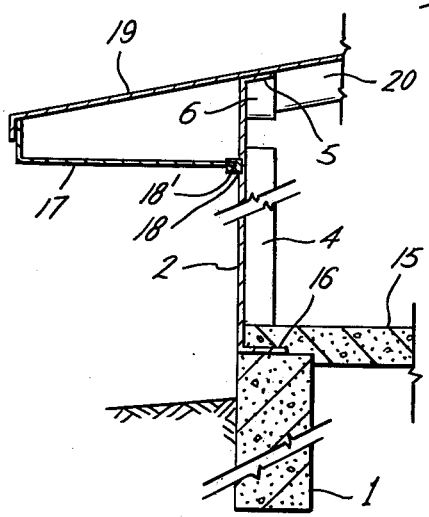
Fig. 4
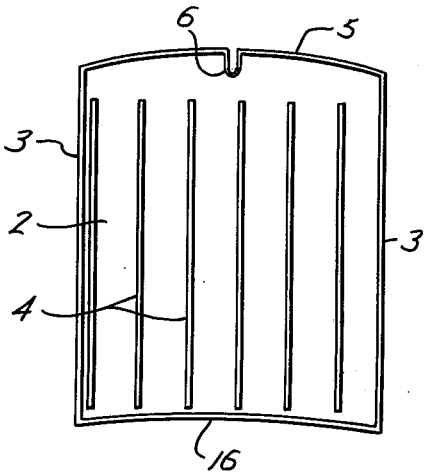
Fig. 5
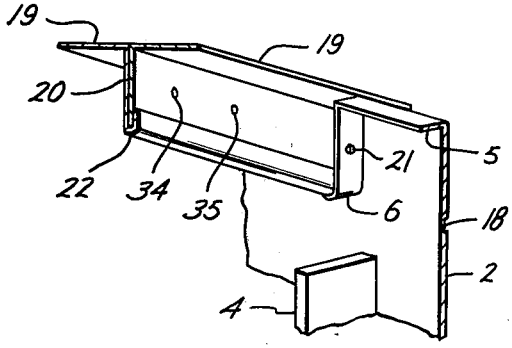
Fig. 6
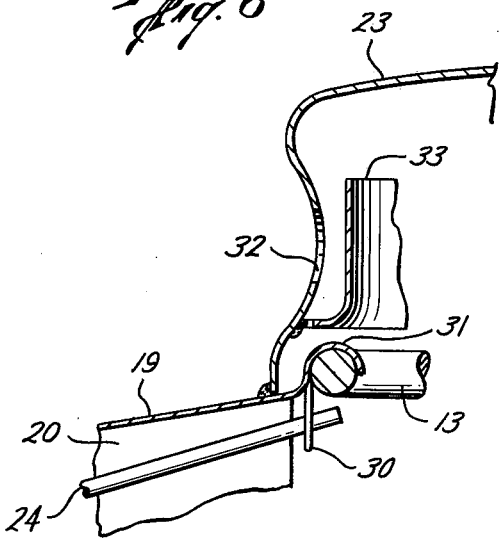
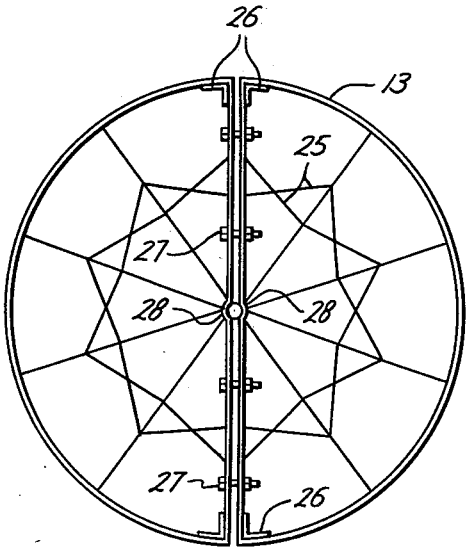
Fig. 7

CIRCULAR BUILDING

BACKGROUND OF THE INVENTION

Preliminary investigation of patents issued on structures of this general nature failed to reveal applicant's structure. The patent to Moss, U.S. Pat. No. 3,118,186, issued Jan. 21, 1964, purported to be a circular building, constructed in panels. However, the details of construction are in no way similar, and are believed to be impractical.

SUMMARY OF THE INVENTION

A circular building having curved vertical wall panels of fiberglass reinforced polyester and substantially triangular roof sections fastened into a solid structure, the roof panels being supported by the wall panels at one end, and a center ring at the other end, which is in turn supported by a tubular column, and a cupola over the center ring.

BRIEF DESCRIPTION OF THE DRAWINGS

FIG. 1 is an elevational, cross sectional view of the completed building.

FIG. 2 is a top plan view of the building, partially in cross section.

FIG. 3 is a fragmentary view, in cross sectional elevation, illustrating the foundation, vertical wall, roof panel and soffit.

FIG. 4 is a front elevational view of a single wall panel.

FIG. 5 is a fragmentary view of the roof-wall juncture.

FIG. 6 is a fragmentary view of the roof panel, cupola juncture, and

FIG. 7 is a top plan view of the two sections forming the center ring.

DESCRIPTION OF THE PREFERRED EMBODIMENT

In the drawings, the numeral 1 designates the building foundation wall. The first step in the construction is to excavate for this wall, in a circular pattern, and with suitable forms, form this foundation wall. The vertical wall panels 2, 2 are then erected, the said panels having internally directed marginal flanges 16 at the bottom edge; longitudinal flanges 3, 3 at the respective longitudinal side edges, and a top flange 5. The respective side flanges of the vertical wall panels which are in abutting relation are secured, as by pop-rivets or bolts, and the troughs formed on the outer surface at the juncture of each abutting panel, are caulked with a silicon caulking. The panels, which are preferably formed of a reinforced fiberglass polyester, have vertical reinforcing studs 4, 4, which are intended as vertical reinforcing means, as well as means for securing wall board, or the like, to the interior wall. Each wall panel 2 is curved horizontally, so that when assembled, a circular wall is formed, and the end margins of each panel have inwardly extending flanges 5, 16, the upper flange being slanted to the same pitch as the pitch of the roof panels, to be hereinafter described, and midway between the longitudinal side margins of each panel, is formed a roof panel flange receiving slot 6.

A center column 7 is set in the center of the floor area by excavating a block receiving area, and setting the center column, such as a steel pipe, in said area. A cap 12 is mounted on the pipe bottom, and four spokes are welded to the pipe 7 and extend radially therefrom, within the said excavated area, said spokes 9, 9 reinforcing said column and the excavated area then filled, forming a block 10, preferably of concrete.

A center ring 13 is mounted on the top of the column 7, and braces 14, 14 extend radially from the column 7 to the ring 13, and rods 25, 25 furnish additional vertical support to said ring. The ring 13 is formed in two sections, with metallic clips 26, 26 and bolts 27, 27 positioned to bring the sections together with the split pipe 28 embracing the column 7.

The concrete floor 15 is poured, covering the flange 16 of the panels 2, and covering the top of the block 10.

The soffit, as 17, which may be formed in sections, and provided with the usual ventillating areas (not shown) is mounted on the wall panels 3 by seating one end of each soffit section in the grooves 18 in the outer surface of the panels, a yieldable gasket, as 18', consists of an annular member of polyvinyl chloride, or the like, having a slot in its outer wall, into which the inside end of the soffit fits, so that when the soffit is inserted in the groove 18, a tight seal is formed. The other end of the soffit sections are secured to the downwardly turned flange 29 at one end of the roof panels 19, as by welding. Each roof panel is substantially triangular, or pie-shaped, and is secured at the wide end in the socket 6, and at the other end to the center ring 13, as by bolts, rivets or the like, through the side flanges, and by welding at the juncture with the soffit and the cupola to be hereinafter described. The abutting flanges 20, 20 of each roof panel seating in the socket 6, one flange margin of said roof panels being upwardly turned forming a channel-shaped trough 22, which receives the lower edge of the abutting roof panel flange, and the abutting flanges being secured together by bolts, or rivets.

Mounted on said center ring is a cupola 23, covering the center ring and providing ventillation through suitably screened openings 32. An inside annular baffle 33 prevents snow, or the like, from entry. The various contact points for the soffit and for the cupola are preferably welded, and the troughs formed by the abutting roof panels are caulked.

Tension bars 24, 24 are secured to each roof panel on the inside vertical wall of the channeled flange, to assist in reducing deflection of the panels. The inwardly extending portion of the bars 24 protrudes past the end of the panel and extends into a stirrup 30 suspended from the ring 13, there being a stirrup on said ring for each roof panel. The roof sections have their inner ends turned upwardly, and then turned back downwardly forming a ring engaging hook 31 which fits over the ring 13 when the roof panel is moved into place. When the roof sections have been mounted with the inner ends in the position shown in FIG. 6, the outside ends, with the soffit sections welded thereon, and pilot bolts 34 anchoring the sections together have been installed, the entire roof may be raised until the gasket 18' has seated in the groove 18, and when the gasket is so seated, the pressure of the roof and soffit will pull the wall panels into the desired circular conformation. The final securing of the structure with pop rivets, or the like, as 35, may then proceed, and the caulking effected and the building thus completed.

A doorway 24 may be formed in the wall panels, and such windows as may be desired (not shown) may be cut in the wall panels. Such floor plan as may be desired is then constructed, and the interior finished in a conventional manner.

What I claim is:

1. In a building, a circular foundation, a center column mounted in said foundation, vertically extended wall panels anchored in said foundation, roof sections mounted on said vertical panels at one end and secured to said center column at the other end, each roof panel being provided with longitudinal reinforcing bars, said reinforcing bars having one end protruding past the inner end of said roof panel, stirrups on said center ring adapted to receive said protruding end of said reinforcing bar and each roof panel being upwardly turned at its inner end, and overturned at its inwardly extending terminal forming a hook extending over and resting on said center ring.

* * * * *